US006665506B1

(12) United States Patent
Wang et al.

(10) Patent No.: US 6,665,506 B1
(45) Date of Patent: Dec. 16, 2003

(54) DEVELOPING MEMBER FOR AN IMAGE FORMING APPARATUS

(75) Inventors: Jui-Chi Wang, Taichung (TW); Robin Hsu, Taichung (TW); Xiao Hui Wang, Taichung (TW)

(73) Assignee: General Plastics Industrial Co., Ltd. (TW)

( * ) Notice: Subject to any disclaimer, the term of this patent is extended or adjusted under 35 U.S.C. 154(b) by 0 days.

(21) Appl. No.: 10/175,615

(22) Filed: Jun. 19, 2002

(30) Foreign Application Priority Data

May 2, 2002 (TW) ..... 091206286

(51) Int. Cl.[7] ..... G03G 15/08
(52) U.S. Cl. ..... 399/106
(58) Field of Search ..... 399/103, 102, 399/106, 105, 258, 259, 260, 262, 111, 113; 222/DIG. 1; 24/114.05, 297; 411/553; D18/43

(56) References Cited

U.S. PATENT DOCUMENTS 4,456,154 A * 6/1984 Herriman ..... 222/DIG. 1
4,615,608 A * 10/1986 Mizutani ..... 399/103
5,229,824 A * 7/1993 Tsusaka et al. ..... 399/262
5,512,987 A * 4/1996 Miller et al. ..... 399/103
5,594,535 A * 1/1997 Beaufort et al. ..... 399/106
5,946,520 A * 8/1999 Hooper et al. ..... 399/103
5,999,770 A * 12/1999 Li ..... 399/106
6,009,289 A * 12/1999 Sekine et al. ..... 399/113
6,014,536 A * 1/2000 Ban et al. ..... 399/258

FOREIGN PATENT DOCUMENTS

JP 05289444 A * 11/1993 ..... G03G/15/00
JP 09120206 A * 5/1997 ..... G03G/15/08
JP 2000338778 A * 12/2000 ..... G03G/15/08
JP 2001305839 A * 11/2001 ..... G03G/15/08

* cited by examiner

*Primary Examiner*—Arthur T. Grimley
*Assistant Examiner*—Ryan Gleitz
(74) *Attorney, Agent, or Firm*—Merchant & Gould LLC

(57) ABSTRACT

A developing member for use in an image forming apparatus is constructed to include a developing member main body containing a developer for developing images, a sealing member sealing developer supply holes of the developing member main body, a grip member connected to one end of the sealing member for the gripping of the hand to pull the sealing member away from the developing member main body, positioning means provided at the grip member, and a position member fixedly provided in one end wall of the developing member main body and adapted for receiving the positioning means of the grip to secure the grip to the end wall of the developing member main body.

5 Claims, 5 Drawing Sheets

DEVELOPING MEMBER FOR AN IMAGE FORMING APPARATUS

BACKGROUND OF THE INVENTION

1. Field of the Invention

The present invention relates to an image forming apparatus and, more specifically, to a developing member for an image forming apparatus.

2. Description of the Related Art

A developing unit for developing a latent image formed on an electrophotographic photosensitive member (see U.S. Pat. No. 6,101,348) includes a developing member for developing the latent image formed on the electrophotographic photosensitive member with developer, a developer containing member for containing the developer, a supply opening provided in the developer containing member and adapted to supply the developer contained within the developer containing member to the developing member, a seal member for sealably sealing the supply opening, a grip member connected to the seal member and to be gripped when the supply opening is unsealed, a support portion for supporting the grip member. According to this design, the grip portion is capable of being separated from the support portion by bending the grip member with respect to the support portion. This design has drawbacks. During transportation of the developing unit, the grip member tends to be separated from the support portion accidentally by an external force. When the seal member unsealed accidentally, the developer will flow out of the developer containing member to contaminate the surroundings.

SUMMARY OF THE INVENTION

The present invention has been accomplished to eliminate the aforesaid problem. It is the main object of the present invention to provide a developing member, which keeps the sealing member positively secured in the sealing status during transportation of the developing unit, preventing leakage of the contained developer. To achieve this and other objects of the present invention, the developing member comprises a developing member main body containing a developer for developing images, a sealing member sealing developer supply holes of the developing member main body, a grip member connected to one end of the sealing member for the gripping of the hand to pull the sealing member away from the developing member main body, positioning means provided at the grip member, and a position member fixedly provided in one end wall thereof of the developing member main body and adapted for receiving the positioning means of the grip to secure the grip to the end wall of the developing member main body.

DETAILED DESCRIPTION OF THE PREFERRED EMBODIMENT

Figure 1:
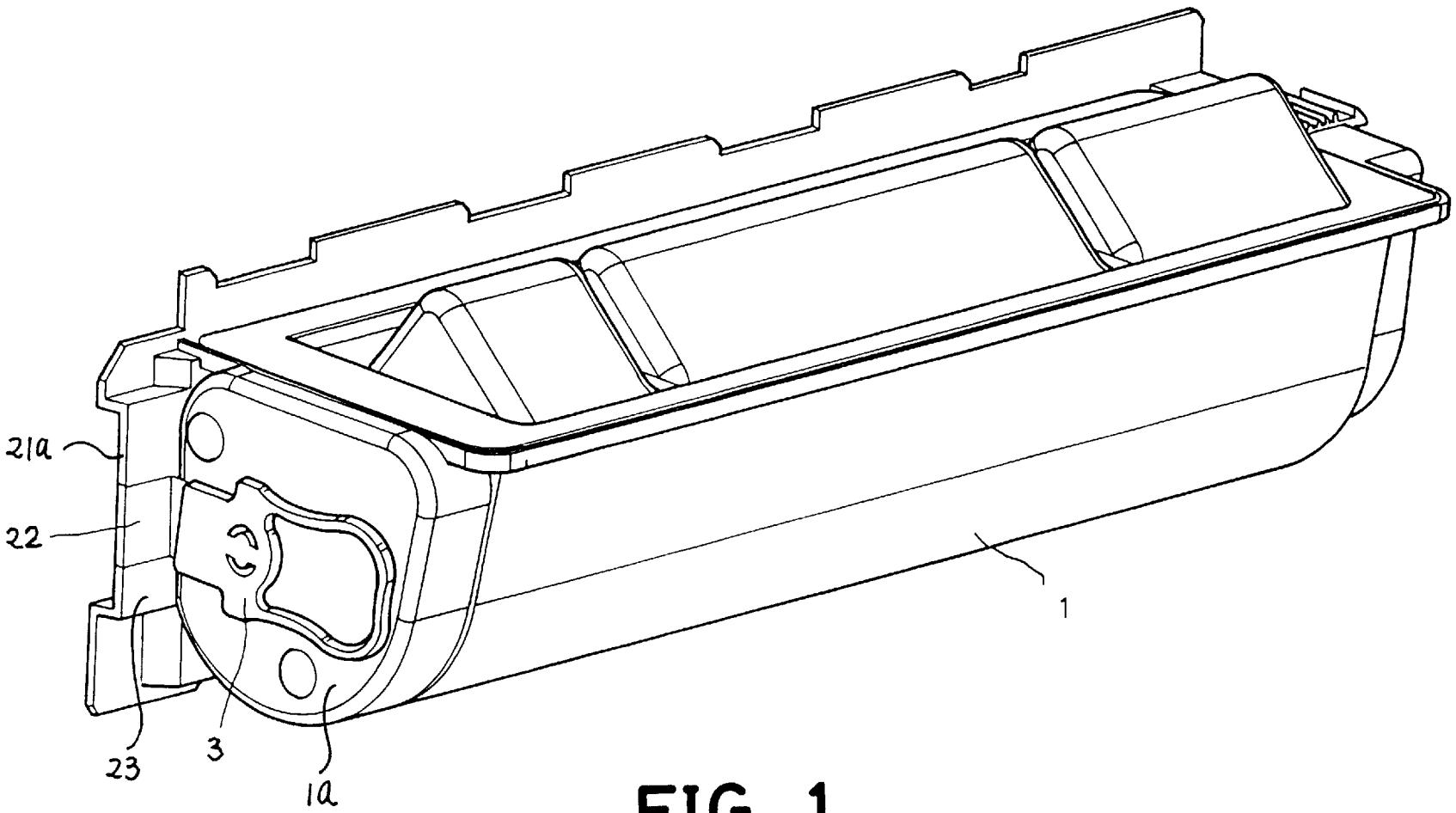
FIG. 1 is a perspective view of a developing member according to the present invention.

Referring to FIG. 1, a developing member in accordance with the present invent is shown comprised of a developing member main body 1, a sealing member 2, a grip member 3, and a position member 4.

Figure 3:
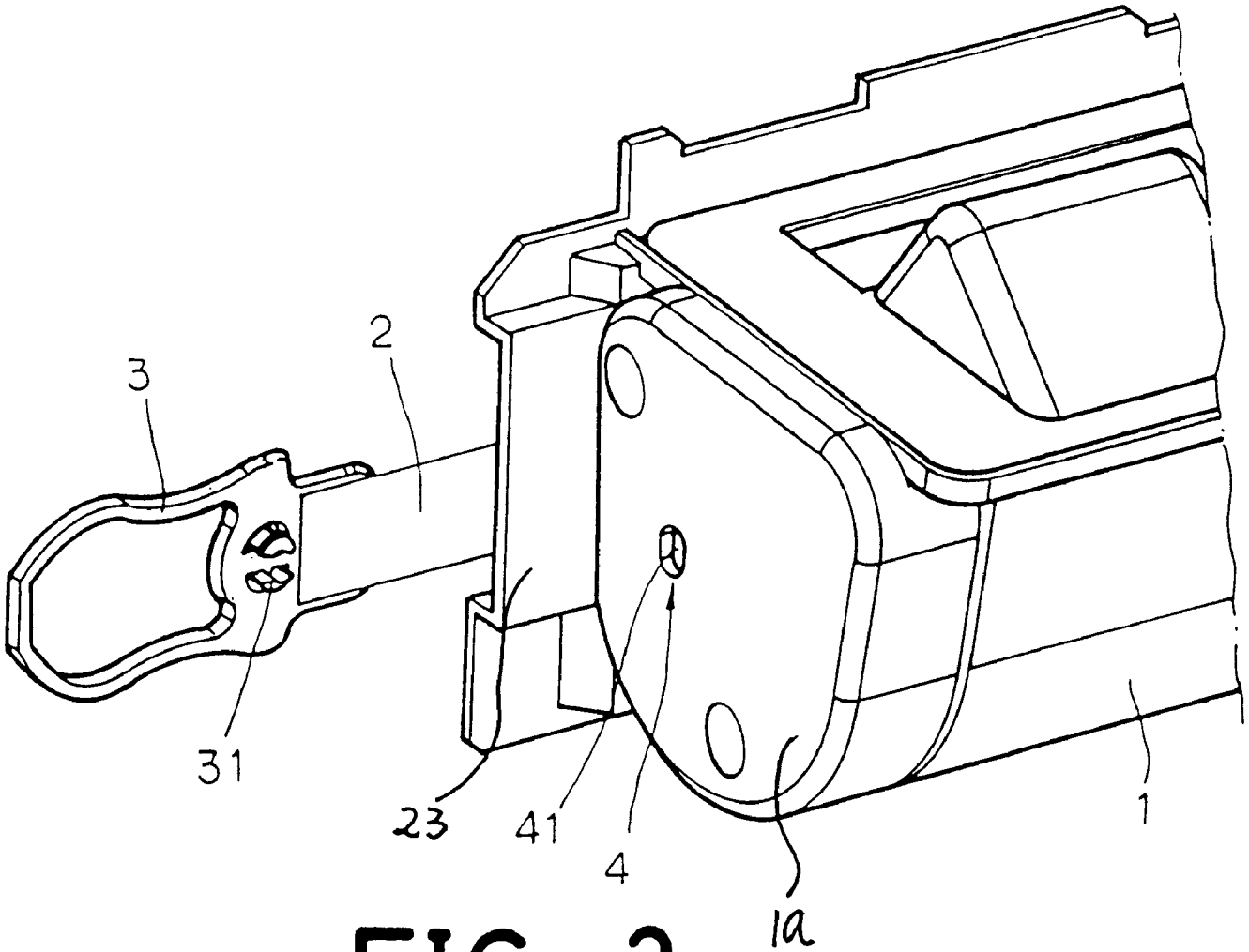
FIG. 3 is a perspective view showing one embodiment of the position member at the developing member main body and the positioning means of the grip member according to the present invention.
Figure 4:
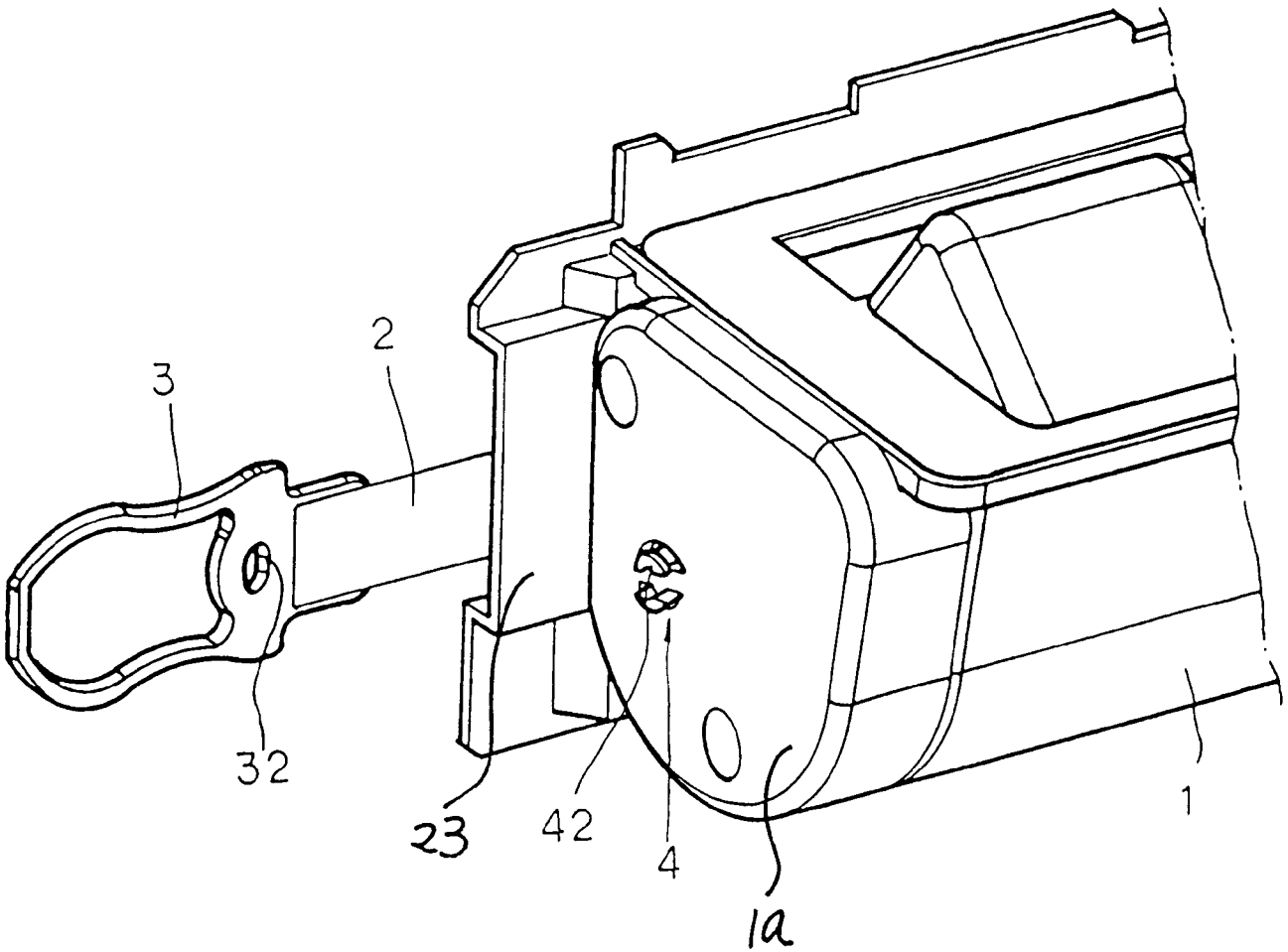
FIG. 4 illustrates an alternate form of the present invention.

Referring to FIGS. 3 and 4 and FIG. 1 again, the developing member main body 1 comprises a row of developer supply holes 11 disposed in one side thereof through which the contained developer is supplied. The sealing member 2 is a thin film of plastics adapted for sealably sealing the developer supply holes 11. The grip member 3 is connected to one end of the sealing member 2, having positioning means for positioning. The positioning means of the grip member 3 may be variously embodied. For example, the positioning means of the grip member 3 can be a split retaining bolt 31 (see FIG. 3), or retaining hole 32 (see FIG. 4).

Figure 5:
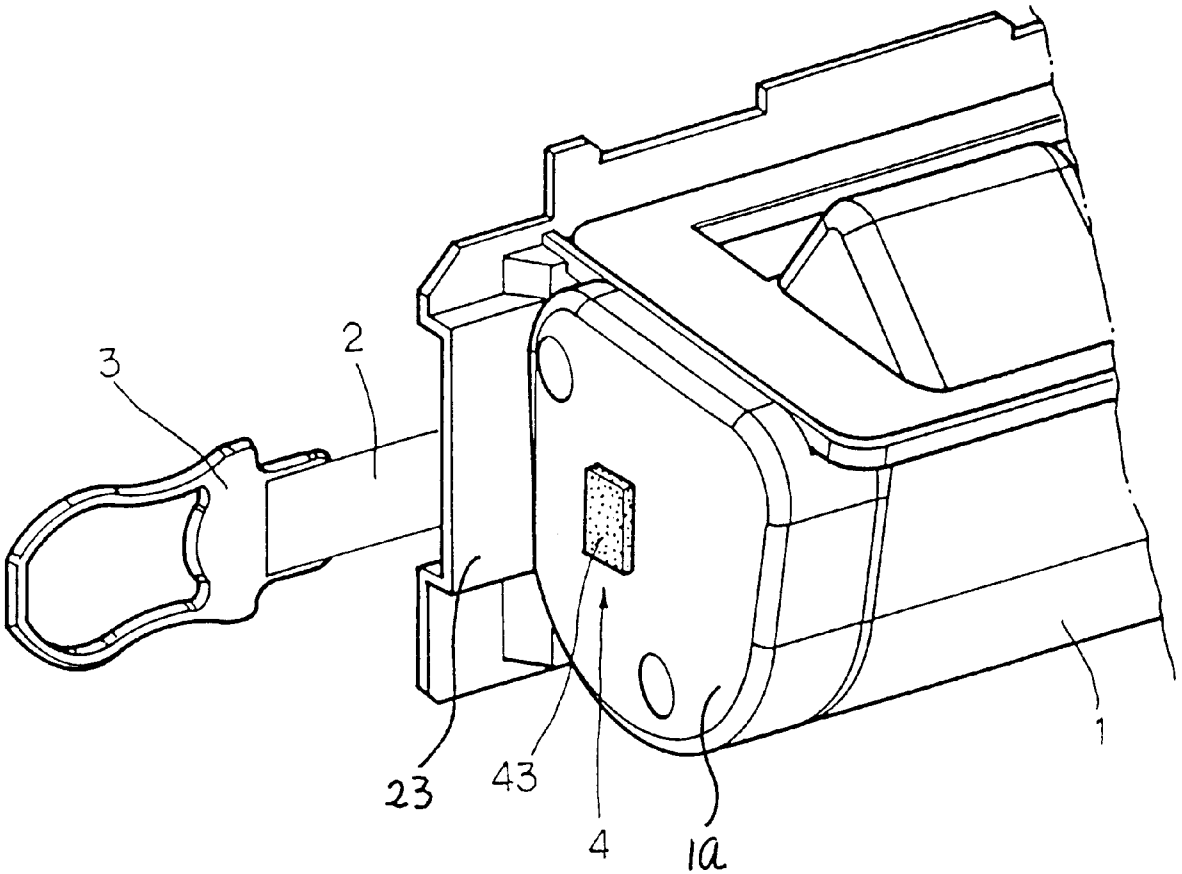
FIG. 5 illustrates another alternate form of the present invention.

Referring to FIGS. from 3 through 5, the position member 4 is fixedly provided in one end wall of the developer container member main body 1, and adapted for securing grip member 3 in position. The position member 4 can also be variously embodied. For example, the position member 4 can be a retaining hole 41 (matching the split retaining bolt 31 of the grip member 3 as shown in FIG. 3), split retaining bolt 42 (matching the retaining hole 32 as shown in FIG. 4), or double-side adhesive tape 43 (for securing a planar surface area of the grip member 3 as shown in FIG. 5).

Figure 2:
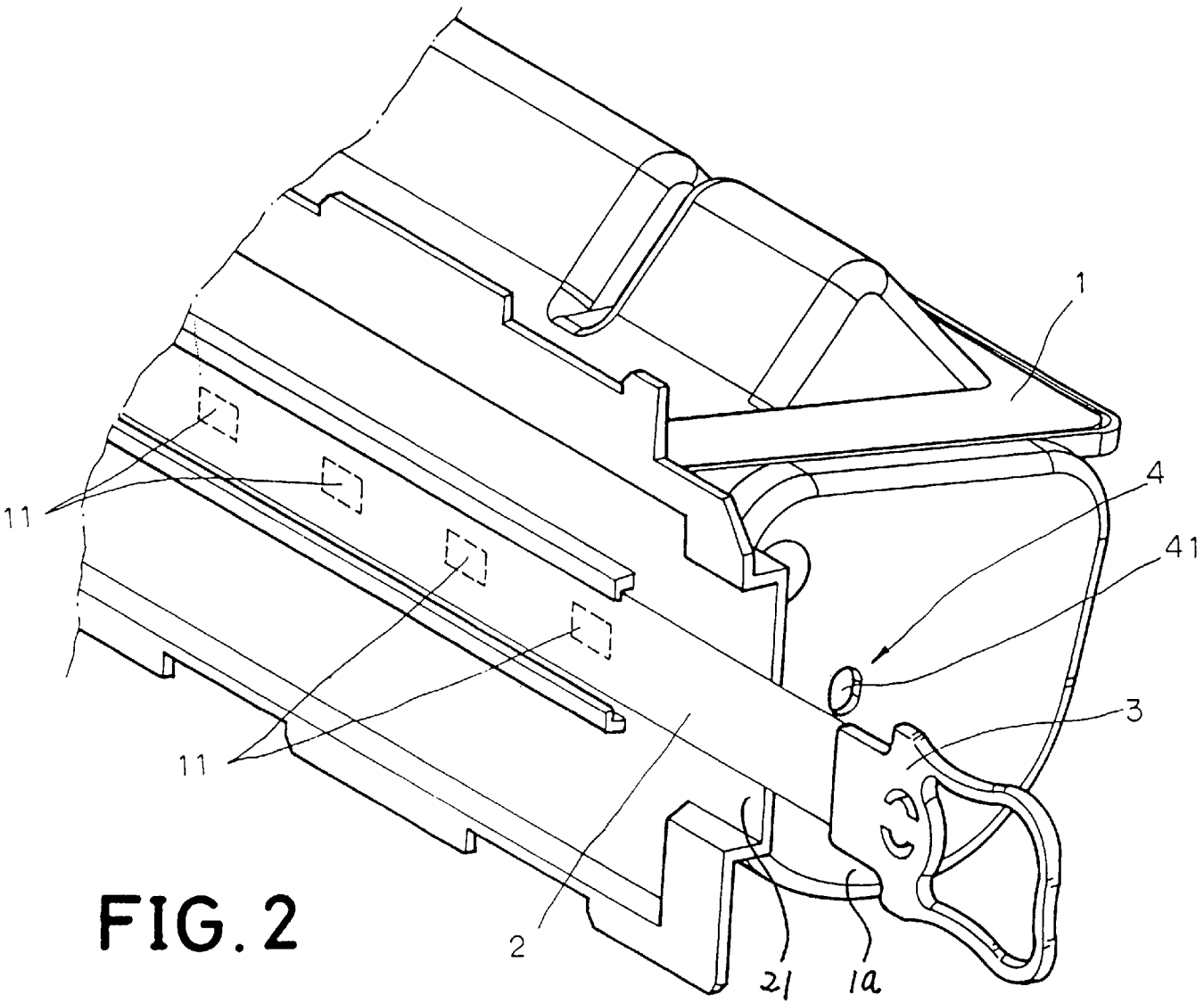
FIG. 2 is a perspective view in an enlarged view of a part of the developing member, showing the grip disconnected from the position member at the developing member main body.

By means of the position member 4, the grip member 3 is closely secured to one end wall of the developing member main body 1, keeping the sealing member 2 in the sealing position. Furthermore, referring now to FIGS. 1 and 2, in one embodiment of the present invention, the surface 21 of the developing member main body 1, wherein the developer supply holes or openings 11 are formed, projects over one end wall 1*a* along the longitudinal axis of the developing member main body 1 such that as positioning means 3 is received by the position member 4, a portion 22 of the sealing member 2 is around an edge 21*a* of the surface 21 and bent over to the back 23 of the surface 21 of the developing member main body 1. This provides a further assurance that the sealing member 2 is positioned properly to seal the developer supply openings 11 even if the postioning means may accidentially disengage from the position member 4.

A prototype of developing member has been constructed with the features of FIGS. 1~5. The developing member functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A developing member comprising:

a developing member main body adapted for containing a developer;

a plurality of developer supply openings for supplying the developer contained in said developing member main body, wherein the plurality of developer supply openings are formed on a surface of the developing member main body substantially along a longitudinal axis of the developing member main body;

a sealing member sealing said developer supply openings;

a grip member connected to one end of said sealing member;

positioning means provided at the grip member; and a position member fixedly provided in one end wall of said developing member main body and adapted for receiving the positioning means of said grip member to secure said grip member to the end wall of said developing member main body and for releasing the positioning means of said grip member to discharge said grip member from the end wall of said developing member main body when desired, wherein said surface of the developing member main body projects over said one end wall along the longitudinal axis of said developing member main body such that as the positioning means is received by said position member, a portion of said sealing member is around an edge of said surface and bent over to the back of said surface of the developing member main body.

2. The developing member as claimed in claim 1, wherein the position member of said developing member main body is a double-side adhesive tape, and the positioning means of said grip member is a planar surface portion in one sidewall of said grip member.

3. The developing member as claimed in claim 1, wherein the position member of said developing member main body is a split retaining bolt, and the positioning means of said grip member is a retaining hole adapted for receiving said split retaining bolt of said position member of said developing member main body.

4. The developing member as claimed in claim 1, wherein the position member of said developing member main body is a retaining hole, and the positioning means of said grip member is a split retaining bolt adapted for engaging into the retaining hole of said position member of said developing member main body.

5. The developing member as claimed in claim 1, wherein said sealing member is a thin film of plastics.

* * * * *